US006453922B1

(12) United States Patent
Dufort

(10) Patent No.: US 6,453,922 B1
(45) Date of Patent: Sep. 24, 2002

(54) PERSONAL COLLAPSIBLE SHELTER

(75) Inventor: Claude Dufort, Winnipeg (CA)

(73) Assignee: Dufort Industries Ltd., Winnipeg (CA)

( * ) Notice: Subject to any disclaimer, the term of this patent is extended or adjusted under 35 U.S.C. 154(b) by 24 days.

(21) Appl. No.: 09/802,903

(22) Filed: Mar. 12, 2001

(51) Int. Cl.[7] ..... E04H 15/58
(52) U.S. Cl. ..... 135/117; 135/87
(58) Field of Search ..... 135/87, 121, 123, 135/124, 117, 115, 116, 119

(56) References Cited

U.S. PATENT DOCUMENTS

| | | | | |
|---|---|---|---|---|
| 4,440,187 A | | 4/1984 | Fiddler | |
| 4,646,770 A | | 3/1987 | Lobato | |
| 4,719,934 A | * | 1/1988 | Mydams | 135/90 |
| 4,739,784 A | | 4/1988 | Fast | |
| 4,870,984 A | * | 10/1989 | Roth | 135/87 |
| 5,215,109 A | | 6/1993 | Kent, Jr. | |
| 5,941,264 A | * | 8/1999 | Gregg | 135/116 |
| 6,138,700 A | * | 10/2000 | Stoddart | 135/87 |

FOREIGN PATENT DOCUMENTS

| | | | | |
|---|---|---|---|---|
| FR | 2695158 | * | 4/1994 | 135/87 |

* cited by examiner

*Primary Examiner*—Beth A. Stephan
(74) *Attorney, Agent, or Firm*—Ryan W. Dupuis; Adrian D. Battison; Michael R. Williams

(57) ABSTRACT

A portable shelter is provided which is particularly useful for shielding seated occupants in a boat and the like from the weather including wind and water spray. The shelter includes a base member and a generally U-shaped frame member which pivotally mounted on the base member for movement between an extended position in which the frame member extends upwardly from the base member and a collapsed position folded alongside the base member. Sheeted material is provided for spanning between base member and the frame member in the extended position. A tensioning mechanism is coupled between the base member and the frame member for biasing the frame member into the extended position with the sheeted material under tension. The tensioning mechanism is collapsible with the frame member into the collapsed position thus providing an easily portable shelter which is self supporting in the extended position.

20 Claims, 3 Drawing Sheets

PERSONAL COLLAPSIBLE SHELTER

FIELD OF THE INVENTION

This invention relates to shelters and more particularly to a personal shelter which is collapsible for portability.

BACKGROUND

Portable shelters are known for protecting persons from the elements including sun, wind and rain. These shelters typically include a sheeted material which is supported on a frame so as to form a shield from the elements.

U.S. Pat. No. 4,739,784 to Fast and U.S. Pat. No. 4,440,187 to Fiddler each provide a portable shelter in which a plurality of arcuate ribs are pivotal relative to one another between a collapsed position adjacent one another and an extended position in which the ribs are spread apart for supporting sheeted material thereacross. In both of these shelters however the ribs are not sufficiently durable nor is the sheeted material to be supported thereon supported under sufficient tension so as to provide adequate protection against strong winds or rain.

U.S. Pat. No. 5,215,109 to Kent and U.S. Pat. No. 4,646,770 to Lobato each provide similar shelters in which a pair of arcuate ribs are supported in a spaced arrangement with sheeted material spanning therebetween. In both of these devices a flexible rod is provided which mounts between the ribs for providing tension to the canvass spanning between the ribs. In either device however awkward manipulation of the flexible rod is required to release the devices into a collapsed position. When used as a portable shelter the flexible rod may thus easily become separated from the shelter when collapsed. Furthermore the arrangement of the flexible rod provides limited tension to the sheeted material as the rod is required to be readily flexible for disassembly.

SUMMARY

According to the present invention there is provided a portable shelter comprising:

a base member spanning from a front end to a rear end of the base member;

an upper frame member including;

a pair of side portions, each extending from an inner end to an outer end of the side portion, the inner ends of the respective side portions being pivotally mounted at respective laterally spaced apart locations on the base member adjacent the rear end of the base member; and an end portion coupled between the respective outer ends of the side portions;

the upper frame member being pivotal between an extended position in which the side portions extend upwardly from the base member with the end portion being spaced above the base member and a collapsed position in which the side portions extend alongside the base member;

flexible sheeted material coupled between the base member and the upper frame member so as to span between the front end of the base member and the end portion of the upper frame member in the extended position of the upper frame member; and a tensioning mechanism coupled between the base member and the upper frame member, the tensioning mechanism being collapsible with the upper frame member from the extended position to the collapsed position and being arranged to bias the end portion of the upper frame member away from the front end of the base member in the extended position such that the flexible sheeted material spanning between the end portion of the upper frame member and the front end of the base member is under tension in the extended position.

The arrangement of the portable shelter of the present invention permits the sheeted material to be supported under strong tension to withstand strong winds and water spray. This is particularly useful for marine applications for shielding the occupants of a boat from wind and water spray which are common when using a boat on open waters. The use of a tensioning mechanism which is collapsible provides a shelter which occupies minimal space when collapsed for portability. By collapsing the tension mechanism the mechanism may remain coupled to the base member in both extended and collapsed positions, thus removing the possibility of the parts of the shelter becoming separated when collapsed. The resulting shelter supports the sheeted material under high tension due to the collapsible tension mechanism which secures the sheeted material under maximum tension in the extended position with no further tension to the sheeted material being required to release the shelter into the collapsed position as is required in the known prior art.

The tensioning mechanism preferably remains coupled to either the upper frame member, the base member or both as the upper frame member is displaced between the extended and collapsed positions.

In the preferred embodiment, the tensioning mechanism includes first and second rigid members which are collapsible in relation to each other as the upper frame member is displaced from the extended position to the collapsed position. An overall length of the first and second rigid members is thus reduced in the collapsed position. It is preferred that the first and second rigid members be supported under compression in the extended position.

In one arrangement, the first and second rigid members may be slidably mounted one inside the other for telescoping movement between the collapsed and extended positions of the upper frame member. In this instance, a stop member is preferably coupled between the first and second rigid members in the extended position to restrict displacement of the first and second rigid members into the collapsed position. In alternative arrangements, the first and second rigid members may be pivoted in relation to one another so as to be folded into the collapsed position. In a folding arrangement, the first and second members may be pivoted over center so as to remain in the extended position with the sheeted material under tension.

In the embodiment described herein, the side portions of the upper frame member are mounted on the base member spaced forwardly from the rear end of the base member and the tensioning mechanism is coupled between the upper frame member and the base member rearward from the respective inner ends of the side portions.

In other embodiments however, the tensioning mechanism may be coupled to extend between the front end of the base member and the upper frame member. In such an embodiment, the tensioning mechanism may also provided telescoping or foldable first and second rigid members so as to bias the upper frame member away from the front end of the base member in the extended position for tensioning the sheeted material.

The tensioning mechanism in the preferred embodiment includes a rigid member arranged to extend rearward from the base member under compression in the extended position of the upper frame member and a tension member arranged to be mounted between the rigid member and the upper frame member under tension in the extended position so as to bias the end portion of the upper frame member away from the front end of the base member in the extended position.

The tension member may comprise flexible sheeted material supported under tension between the rigid member and the upper frame member in the extended position. This may be formed integrally with the sheeted material extending between the end portion of the upper frame member and the front of the base member or may be formed as a separate sheet of material.

There may be provided an intermediate frame member coupled to the base member for additionally supported the sheeted material in the extended position. The intermediate frame member would include a pair of side portions and an end portion similarly to the upper frame member and would be mounted on the base member forward of the upper frame member, also for pivotal movement between the extended and collapsed positions.

Both the upper frame member and the intermediate frame member are preferably arranged to lie generally parallel to the base member in the collapsed position. This may be accomplished by including an inner bent portion on each side portion of the upper frame member adjacent the base member which is arranged to extend upward at a rearward incline in the extended position with an outer portion extending upwardly from the inner bent portion at a forward incline in relation to the inner bent portion. The inner bent portions of the side portions of the upper frame member are thus arranged to extend over the intermediate frame member in the collapsed position.

The base member, the upper frame member and the intermediate frame member are preferably all formed of rigid material. The members may each be formed by a continuous arcuate shaped piece of aluminum tubing which has been pre-formed into the desired shape. Aluminum tubing is lightweight while providing sufficient structural rigidity.

The sheeted material preferably includes a main portion coupled between the front end of the base member and the end portion of the upper frame member and a pair of side portions spanning from respective sides of the main portion to respective sides of the base member substantially the full length of the base member.

The upper frame member may be arranged to be substantially longer between respective ends of the side portions thereof than the base member from the front end to the rear end thereof. The resulting shield may thus be sufficient in height to shield a seated person while occupying minimal floor space.

At least a portion of the sheeted material adjacent the end portion of the upper frame member is preferably formed of transparent material for visibility.

A plurality of mounts are preferably arranged to secure the base member to a supporting surface, for example the floor of a boat and the like. Each mount preferably includes a first portion arranged to be secured to a supporting surface and a second portion which mounts the base member to the first portion. With the second portion being selectively separable from the first portion the base member may be selectively released from the supporting surface.

The upper frame member is preferably suitably sized such that the sheeted material in the extended position is arranged to shield a person supported in a seated position rearward of the sheeted material. The shield is thus particularly useful in shielding a person seated in a boat from wind and water spray.

BRIEF DESCRIPTION OF THE DRAWINGS

In the accompanying drawings, which illustrate an exemplary embodiment of the present invention.

DETAILED DESCRIPTION

Figure 4:
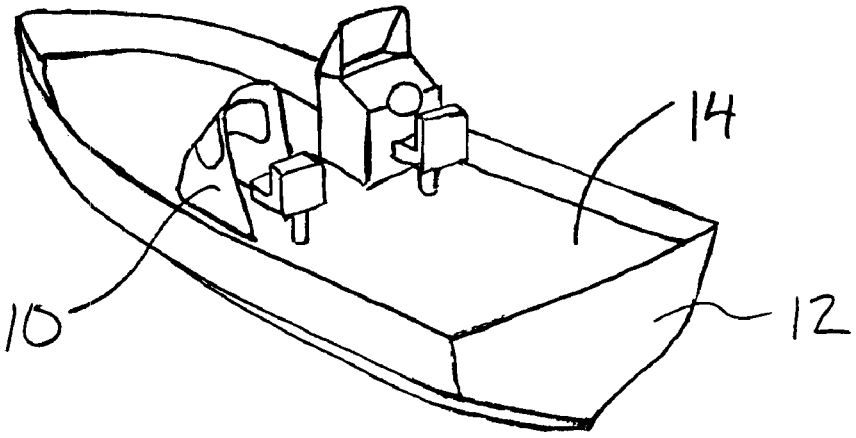
FIG. 4 is an isometric view of the portable shelter shown mounted on the floor of a boat for shielding a seated passenger of the boat.
Figure 5:
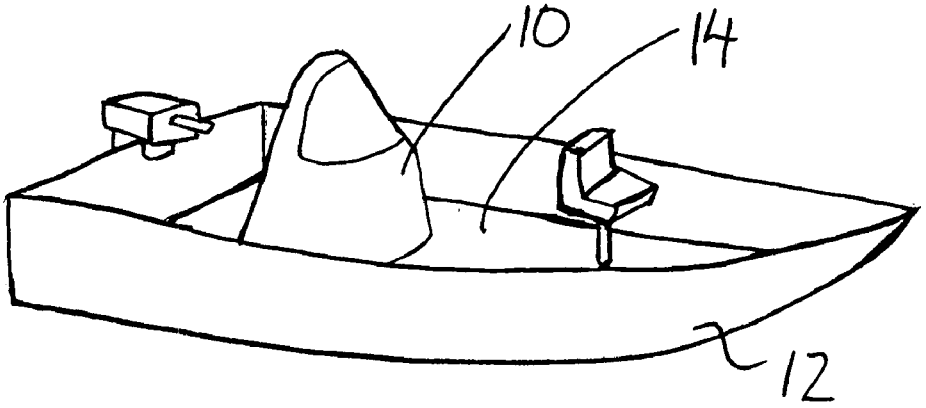
FIG. 5 is an isometric view of the portable shelter shown mounted on the floor of a stern drive boat for shielding a seated driver at the stem of the boat.

Referring to the accompanying drawings, there is illustrated a portable shelter generally indicated by reference numeral 10. The shelter is intended for shielding a person from the weather and is particularly suited as illustrated in FIGS. 4 and 5 for shielding a seated occupant of a boat 12 when the shelter is secured to the floor 14 of the boat. The seated occupant may either comprise a passenger as shown in FIG. 4 or a driver seated at the stern of a boat as shown in FIG. 5.

The shelter 10 includes a base member 16 which comprises a generally U-shaped tubular member of rigid material. The base member includes a curved front end 18 from which a pair of parallel and spaced apart sides 20 extend rearwardly therefrom to a rear end of the base member.

Figure 1:
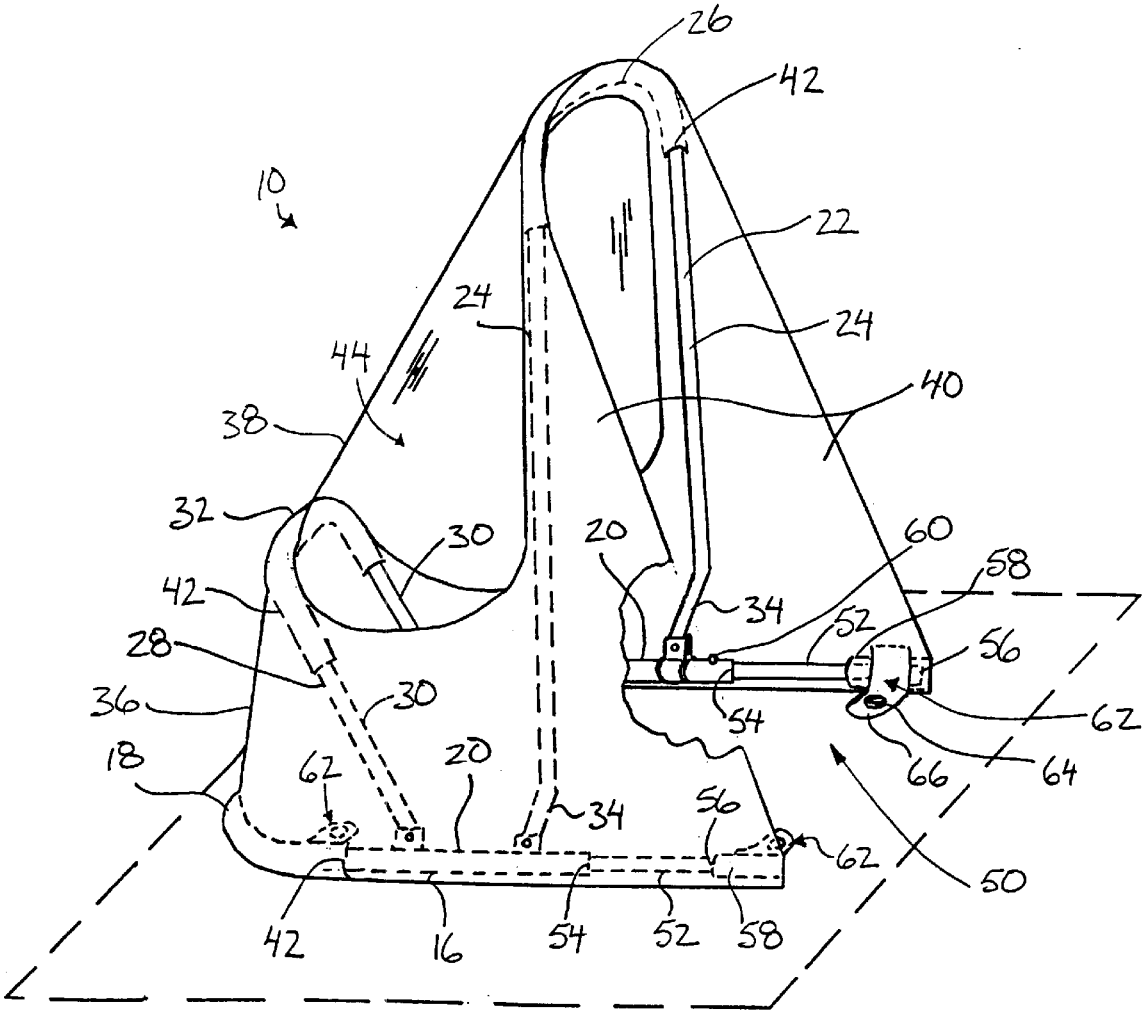
FIG. 1 is an isometric view of the portable shelter in the extended position with a section of sheeted material shown cut away.
Figure 2:
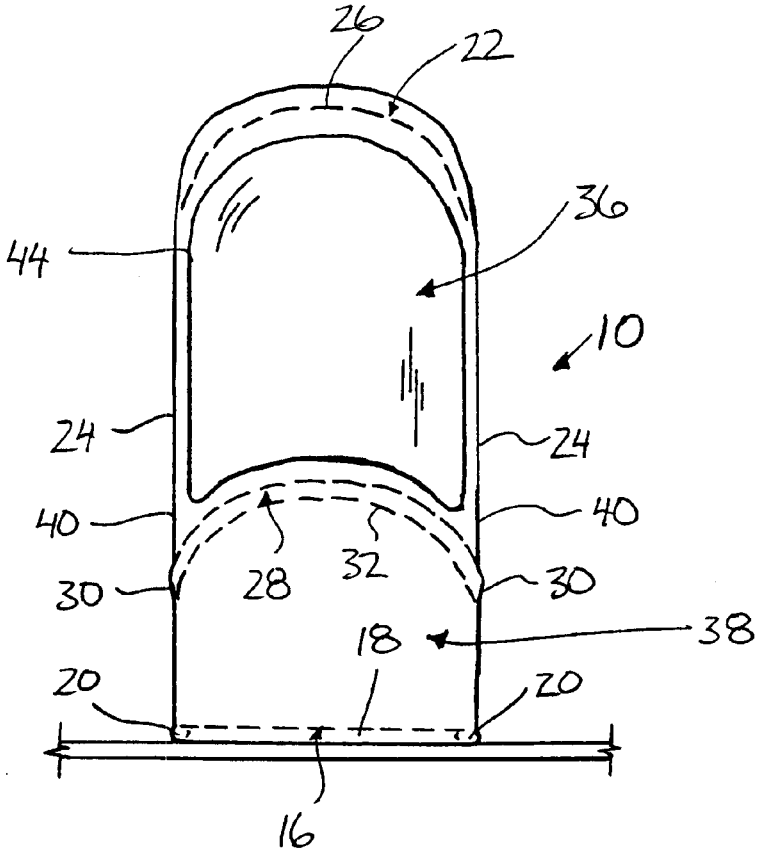
FIG. 2 is a front elevational view of the portable shelter of FIG. 1.

An upper frame member 22 is arranged to be coupled to the base member for relative pivotal movement therebetween. The upper frame member is also generally U-shaped including a pair of sides 24 which are pivotally mounted at respective inner ends on the respective sides 20 of the base member laterally spaced apart adjacent the rear end of the base member. A curved end 26 extends between the respective outer ends of the sides 24 of the upper frame member 22. The upper frame member 22 is thus arranged to be pivotal between a collapsed position as illustrated in FIG. 3 wherein the sides 24 of the upper frame member lie parallel along side the sides 20 of the base member and in extended position as illustrated in FIG. 1 wherein the upper frame member 22 extends upwardly from the base member 16.

The upper frame member 22 is arranged to be longer between the inner and outer ends of the sides thereof than an overall length of the base member from the front end to the rear end thereof. In this arrangement the shelter in the extended position as illustrated in FIG. 1 is sufficient in height to provide a large shielding surface while occupying minimal floor space.

An intermediate frame member 28 is also provided which is similar in configuration to the upper frame member 22. The intermediate frame member 28 is generally U-shaped having a pair of sides 30 which are pivotally mounted on respective sides of the base member at an inner end of the sides 30, spaced part way between the front and rear ends of the base member. A curved end portion 32 extends between respective outer ends of the sides 30 of the intermediate frame member 28.

Figure 3:
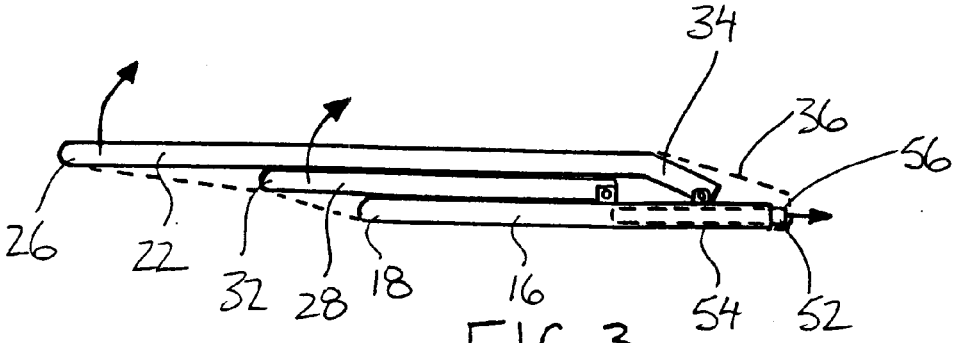
FIG. 3 is a side elevational view of the portable shelter of FIG. 1 in the collapsed position with the sheeted material shown in dotted line.

The intermediate frame member 28 is approximately half the size in overall length than the upper fame member 22 and is similarly pivotal between a collapsed position as illustrated in FIG. 3 in which the intermediate frame member 28 lies substantially parallel and flat along side the base member and an extended position in which the intermediate frame member 28 extends upwardly at a forward incline with the curved end 32 thereof being spaced above the curved front end 18 of the base member.

In order for the upper frame member 22 to lie flat along side the intermediate frame member 28 in the collapsed position as illustrated in FIG. 3, an inner bent portion 34 is provided at an inner end of each side 24 of the upper frame member 22. In the extended position the inner bent portion 34 of each side 24 of the upper frame member 22 extends upward at a rearward incline with a remaining portion of each side 24 extending upward from the inner bent portion at a forward incline in relation thereto. In the collapsed position the intermediate frame member 28 thus lies parallel directly adjacent the base member 16 while the upper frame member 22 lies parallel and spaced above the base member 16 with the inner bent portions 34 extending forwardly at an upward incline a thickness which is approximately equal to the thickness of the intermediate frame member 28.

A sheeted canvas material 36 is arranged to be supported on the frame members for shielding against the weather. The canvas material 36 is thus arranged to be wind and waterproof. The canvas material 36 includes a main portion which spans between the front end 18 of the base member and the curved outer end 26 of the upper frame member 22. The material 36 also spans across the curved outer end 32 of the intermediate frame member 28 spaced between base member and the upper frame member in the extended position.

The canvas material also includes pair of side portions 40 extend from respective sides of the main portion 38, spanning between the main portion and a respective side 20 of the base member 16 substantially the full length of the base member. The side portions 40 thus also extend across the sides of the upper and intermediate frame members.

A set of curved envelopes 42 are formed into the sheeted canvas material 36 for receiving a respective curved end of the base member and both frames members therein. The sheeted canvas material 36 thus remains secured to the frame members and the base member as the frame members are pivoted into the collapsed position in which the canvas material 36, being flexible, is folded between the frame members and the base member.

A portion of the canvas material 36 between the upper frame member and the intermediate frame member is arranged to be transparent so as not to obstruct the visibility of a person being shielded by the shelter 10. Situating the transparent portion 44 adjacent the outer curved end of the upper frame member 22 provides suitable visibility when the shelter 10 is suitably sized to shield a person in a seated position as illustrated in FIG. 4.

A tensioning mechanism generally indicated by reference numeral 50 is situated on the base member 16 rearward of the upper frame member 22. The tensioning mechanism 50 is arranged to bias the outer curved end 26 of the upper frame member 22 away from the front end 18 of the base member 16 in the extended position for providing tension to the canvas material extending therebetween.

The tensioning mechanism 50 includes a pair of first rigid members 52 which are slidably received within a respective pair of second tubular rigid members 54 which are integrally formed at a rear end on respective sides 20 of the base member 16. The second rigid members 54 are tubular and arranged to slidably receive the respective first rigid members 52 therein in a telescopic manner for reducing the overall length of the base member in the collapsed position.

The respective outer ends 56 of the first rigid members 52 are arranged to be received within respective pockets 58 formed in the canvas material 36 at a rear end thereof. The sides portions 40 of the canvas material 36 which extends from the outer ends 56 of the first rigid members 52 to the outer curved end 26 of the upper frame member 22 thus acts as respective tension members for biasing the upper frame member 22 rearwardly in the extended position.

As illustrated in FIG. 3 when the first rigid members 52 are telescopically received within the second rigid members integrally formed at the rear end of the base member 16, the frame members are permitted to be folded into the collapsed position due to the slack in the canvas sheeted material 36. Extending the first rigid members 52 rearwardly into the extended position pulls the tension members defined by the side portions 40 of the canvas material, which extend rearward from the upper frame member 22, to bias the upper frame member 22 away from the front end of the base member 16 in the extended position. Maximum tension to the sheeted canvas material 36 is provided when the telescoping rigid members are fully extended as illustrated in FIG. 1.

A stop member 60 mounted on each first rigid member 52 is arranged to co-operate with a respective aperture on the respective second rigid members 54 for securing the first rigid members in the extended position. The stop members 60, each comprise a resilient member which is arranged to be selectively deflected radially inwardly so as to be released from the respective co-operating aperture in the second rigid member. When extending the first rigid members the stop members automatically deflect outwardly into the co-operating apertures in the second rigid members when the stop member and the aperture become aligned, thus securing the first rigid members in the extended position until the stop members are again released.

A pair of mounts 62 are spaced apart on each side of the base member 16 for securing the shelter 10 to a suitable supporting surface, for example the floor 14 of a boat as illustrated in FIG. 4. Each mount 62 includes a first portion which is arranged to be secured to the supporting surface by a suitable fastener, for example screws or rivets and the like. A second portion 66 of each mount comprises a flap of material, formed on the sheeted canvas material 36 adjacent the base member 16, which is arranged to be selectively secured to the respective first portion 64 of the mount. The first and second portions of the respective mounts may comprise any form of mating fasteners which permit selective separation and reattachment thereof such that the shelter 10 remains readily removable from the supporting surface for portability.

The shelter 10 is compact in the collapsed position as illustrated in FIG. 3 so as to be readily portable with the frame members being folded flat and parallel to one another. The base member and both frame members are each formed of lightweight aluminum tubing formed in a single arcuate piece so as to be lightweight and easily manufactured. The canvas sheeted material 36 is also lightweight and easily folded in the collapsed position as illustrated in dotted line in FIG. 3.

For use as a shield, the frame members 22 and 28 are pivoted upwardly in the direction indicated by the arrows on FIG. 3 until the frame members are generally upright in the extended position. Extension of the first rigid members rearwardly from the second rigid members results in the side portions 40 of the sheeted canvas material 36 being pulled rearwardly by the pockets 58 which receive the outer ends of the first rigid members. The frame members are thus biased rearward by the tension in the side portions 40 of the canvas material to also provide tension to the main portion 38 of the sheeted canvas material.

When the rigid members are extended to a point where the tension in the sheeted canvas material reaches a maximum, the stop members 60 become aligned with their respective co-operating apertures so as to be automatically deflected therethrough for restricting the rigid members from being collapsed.

The shelter 10 is thus provided with a self-standing frame which can be selectively mounted on a supporting surface or used independently, while providing maximum tension to the sheeted canvas material 36 thereon in the extended position. The shelter 10 is suitably sized in the extended position to shield a seated occupant, in a boat for example, due to the arrangement of the upper frame member 22 which is longer between respective ends thereof than the height of an average person in a seated position.

In further embodiments the tensioning mechanism may include rigid members which are arranged for relative sliding movement or folding movement as opposed to the telescoping movement described herein. Further variations include mounting the collapsible portion of a tensioning mechanism between a forward end of the base member and the upper frame member as opposed to being positioned rearwardly thereof. Any arrangement using a collapsible member which is rigid in the extended position is suitable for providing sufficient tension to the sheeted canvass material supported thereon for withstanding strong winds and pelting water resulting from rain or water spray when used on a boat. When used for different applications it may be preferable to provide more or fewer of the U-shaped frame members to vary the desired shape and overall dimensions of the shelter.

While one embodiment of the present invention has been described in the foregoing, it is to be understood that other embodiments are possible within the scope of the invention. The invention is to be considered limited solely by the scope of the appended claims.

What is claimed is:

1. A portable shelter comprising:

a base member spanning from a front end to a rear end of the base member;

an upper frame member including;

a pair of side portions, each extending from an inner end to an outer end of the side portion, the inner ends of the respective side portions being pivotally mounted at respective laterally spaced apart locations on the base member adjacent the rear end of the base member; and an end portion coupled between the respective outer ends of the side portions;

the upper frame member being pivotal between an extended position in which the side portions extend upwardly from the base member with the end portion being spaced above the base member and a collapsed position in which the side portions extend alongside the base member;

flexible sheeted material coupled between the base member and the upper frame member so as to span between the front end of the base member and the end portion of the upper frame member in the extended position of the upper frame member; and a tensioning mechanism coupled between the base member and the upper frame member, the tensioning mechanism being collapsible with the upper frame member from the extended position to the collapsed position and being arranged to bias the end portion of the upper frame member away from the front end of the base member in the extended position such that the flexible sheeted material spanning between the end portion of the upper frame member and the front end of the base member is under tension in the extended position.

2. The shelter according to claim 1 wherein the tensioning mechanism remains coupled to the base member as the upper frame member is displaced between the extended and collapsed positions.

3. The shelter according to claim 1 wherein the tensioning mechanism remains coupled to both the upper frame member and the base member as the upper frame member is displaced between the extended and collapsed positions.

4. The shelter according to claim 1 wherein the tensioning mechanism includes first and second rigid members which are collapsible in relation to each other as the upper frame member is displaced from the extended position to the collapsed position, an overall length of the first and second rigid members being arranged to be reduced in the collapsed position.

5. The shelter according to claim 4 wherein the first and second rigid members are supported under compression in the extended position.

6. The shelter according to claim 4 wherein the first and second rigid members are slidably mounted one inside the other for telescoping movement between the collapsed and extended positions of the upper frame member.

7. The shelter according to claim 4 wherein there is provided a stop member coupled between the first and second rigid members in the extended position, the stop member being arranged to restrict displacement of the first and second rigid members into the collapsed position.

8. The shelter according to claim 1 wherein the side portions of the upper frame member are mounted on the base member spaced forwardly from the rear end of the base member and the tensioning mechanism is coupled between the upper frame member and the base member rearward from the respective inner ends of the side portions.

9. The shelter according to claim 8 wherein the tensioning mechanism includes a rigid member arranged to extend rearward from the base member under compression in the extended position of the upper frame member and a tension member arranged to be mounted between the rigid member and the upper frame member under tension in the extended position so as to bias the end portion of the upper frame member away from the front end of the base member in the extended position.

10. The shelter according to claim 9 wherein the tension member comprises flexible sheeted material supported under tension between the rigid member and the upper frame member in the extended position.

11. The shelter according to claim 1 wherein there is provided an intermediate frame member coupled to the base member, the intermediate frame member including:

a pair of side portions, each extending from an inner end to an outer end of the side portion, the inner ends of the respective side portions being pivotally mounted at respective laterally spaced apart locations on the base member forward of the upper frame member; and an end portion coupled between the respective outer ends of the side portions;

the intermediate frame member being pivotal between the extended position in which the side portions extend upwardly from the base member with the end portion being engaged with the sheeted material and the collapsed position in which the side portions extend alongside the base member.

12. The shelter according to claim 11 wherein both the upper frame member and the intermediate frame member are arranged to lie generally parallel to the base member in the collapsed position.

13. The shelter according to claim 12 wherein the side portions of the upper frame member each include an inner bent portion adjacent the base member arranged to extend upward at a rearward incline in the extended position and an outer portion which extends upwardly from the inner bent portion at a forward incline in relation to the inner bent portion, the inner bent portions of the side portions of the upper frame member being arranged to extend over the intermediate frame member in the collapsed position.

14. The shelter according to claim 1 wherein the base member and the upper frame member are formed of rigid material.

15. The shelter according to claim 1 wherein the sheeted material includes a main portion coupled between the front end of the base member and the end portion of the upper frame member and a pair of side portions spanning from respective sides of the main portion to respective sides of the base member substantially the full length of the base member.

16. The shelter according to claim 1 wherein the upper frame member is longer between respective ends of the side portions thereof than the base member from the front end to the rear end thereof.

17. The shelter according to claim 1 wherein at least a portion of the sheeted material adjacent the end portion of the upper frame member is formed of transparent material.

18. The shelter according to claim 1 wherein there is provided a plurality of mounts arranged to secure the base member to a supporting surface.

19. The shelter according to claim 18 wherein each mount includes a first portion arranged to be secured to a supporting surface and a second portion which mounts the base member to the first portion, the second portion being selectively separable from the first portion for releasing the base member from the supporting surface.

20. The shelter according to claim 1 wherein the upper frame member is suitably sized such that the sheeted material in the extended position is arranged to shield a person supported in a seated position rearward of the sheeted material.

* * * * *